United States Patent [19]

Sanford et al.

[11] 4,146,125

[45] Mar. 27, 1979

[54] BITUMEN-SODIUM HYDROXIDE-WATER EMULSION RELEASE AGENT FOR BITUMINOUS SANDS CONVEYOR BELT

[75] Inventors: Emerson Sanford, Edmonton; Robert Shaw, Leduc, both of Canada

[73] Assignees: Petro-Canada Exploration Inc., Calgary; Her Majesty the Queen in right of the Province of Alberta, Government of the Province of Alberta, Department of Energy and Natural Resources, Alberta Syncrude Equity, Edmonton; Ontario Energy Corporation; Imperial Oil Limited, both of Toronto; Canada-Cities Service, Ltd., Calgary; Gulf Oil Canada Limited, Toronto, all of Canada

[21] Appl. No.: 847,595

[22] Filed: Nov. 1, 1977

[51] Int. Cl.[2] ..... E21C 41/10

[52] U.S. Cl. ..... 198/500; 428/352; 264/338; 264/213; 156/289; 106/2

[58] Field of Search ..... 198/495, 500; 156/289; 428/352; 106/2; 264/338, 213

[56] References Cited

U.S. PATENT DOCUMENTS 3,529,868 9/1970 Hogg ..... 198/500

*Primary Examiner*—Sam Silverberg
*Attorney, Agent, or Firm*—Ernest Peter Johnson

[57] ABSTRACT

An emulsion of bitumen in sodium hydroxide solution containing at least 1 wt. % bitumen as the disperse phase is useful, when spread over the load-bearing surface of a conveyor carrying bituminous sands, to act as a release agent to promote the clean separation of the tacky sands from the belt when the latter rounds the end roller of the conveyor system and unloads the sands.

8 Claims, No Drawings

BITUMEN-SODIUM HYDROXIDE-WATER EMULSION RELEASE AGENT FOR BITUMINOUS SANDS CONVEYOR BELT

BACKGROUND OF THE INVENTION

This invention relates to a method which comprises treating the load-bearing surface of the endless belt of a conveyor system with a release agent which is operative to cause bituminous sands subsequently deposited on the belt to separate cleanly therefrom when the belt rounds the end roller of the system.

The invention finds application with respect to a conveyor belt of nitrile or other rubber composition used to convey bituminous sands from a storage bin to a hot water process extraction circuit for recovering bitumen from the sands.

Bituminous sands, when dropped onto a conveyor belt from a height of several feet, tend to adhere to the belt surface when it rounds the end roller. Some of the adhering sands remain attached to the belt and build up on it to form an uneven load thereon. Other portions of the sands drop off the belt as it returns to the starting point of the system. To give some idea of the magnitude of this latter problem, in the 125,000 barrels of bitumen produced per day facility being constructed by the assignees of this invention, it is estimated that, in the absence of a suitable release agent, a deposit of tar sand 17 feet high would be generated beneath the conveyor belt each day. Indeed, provision has been made to permit mechanical shovels to drive beneath the conveyor belt to remove this material.

Out of doors, the problem has been solved by applying a liquid hydrocarbon, such as diesel fuel, to the belt surface before the sands are deposited thereon. However, this prior art belt release agent cannot be used on the conveyor belt connecting the storage bin and the conditioning drum in a hot water process extraction plant, as the belt is housed and the danger of fire or an explosion is too great.

In seeking a release agent for use on this belt, a set of criteria which the agent must satisfy has been developed. More particularly, the release agent must:

(a) when applied to the belt in moderate volume, effectively cause the sands to release from the belt surface when it is unloading at the end roller;

(b) be non-flammable;

(c) not be harmful to the hot water extraction process;

(d) not be harmful to the conveyor belt material nor render repair difficult should damage occur to the belt; and (e) be non-toxic and non-corrosive.

SUMMARY OF THE INVENTION

In accordance with the invention it has been found that an emulsion comprising bitumen, sodium hyroxide and water, when spread over the load-bearing surface of a conveyor belt which is to transport bituminous sands, is a satisfactory release agent for use on the belt. Preferably the emulsion should contain at least 1 wt. % of bitumen to achieve optimum release efficiency. For satisfactory emulsification of this minimum amount of bitumen it is preferred to use at least 0.1 wt. % of sodium hyroxide. The quantity of bitumen may be increased above the 1 wt. % herein recommended but, preferably, the quantity of sodium hydroxide should then be proportionately increased. Preferably the application of the emulsion should be at the rate of at least about 0.76 gallons per thousand square feet of conveyor belt. Users of the invention however should vary the composition of the emulsion and the quantity applied to the conveyor according to the requirements of conveyor being treated and the nature of the tar sand in question at any one time.

Bitumen is best used in the unpurified form as it occurs in froth from the hot water extraction process. Although bitumen isolated from froth is an excellent starting material for the preparation of the emulsion, such purified bitumen, having been freed from water and mineral solids present in the froth, is relatively expensive and its use offers little advantage over untreated froth.

The bitumen, water and sodium hydroxide are vigorously mixed in such proportions as to produce a stable emulsion. The resulting emulsion may then be sprayed on to the conveyor at a point just before the belt is impacted by the tar sand.

Both sodium hydroxide and bitumen emulsified by sodium hydroxide are beneficial to the hot water extraction process so that there is no appreciable danger, as there is in the case of some other belt agents, of extraction efficiency being reduced from this cause.

The use of bitumen emulsified with sodium hydroxide has the further advantage that by its use nothing is added in the usual operation of that process. Hence there is no appreciable danger of a build up of unwanted ions in water recycled to the extraction circuit. A yet further advantage is that although a slight amount of bitumen must be removed from the hot water extraction process product for use as a constituent of the emulsion, nevertheless this small quantity finds its way back to the extraction circuit along with the tar sand fed to the tumbler.

Broadly stated, the invention is an improvement of the process wherein bituminous sands are deposited on and transported by an endless conveyor belt to its end where the sands are unloaded as the belt rounds the end roller. The improvement comprises treating the sands-bearing surface of the belt with an emulsion comprising bitumen in sodium hydroxide solution prior to depositing the bituminous sands thereon to provide a release agent which is operative to effect clean separation of the sands from the surface during the unloading operation.

DESCRIPTION OF THE PREFERRED EMBODIMENT

The invention has been developed by subjecting a broad range of compounds to one or both of two tests, namely: (1) a tar sand release efficiency test; and (2) a test to determine whether the use of the compound would have a seriously deleterious effect on the hot water extraction.

The test apparatus for release efficiency comprised a 15 ton punch press assembly. The original die set was replaced with a spring-loaded adapter designed to accommodate belting samples. A number of $6 \times 6 \times \frac{1}{8}$ inch samples of Goodyear* Rubber Company B3835 neoprene belt surfacing material were used for testing. Each sample or block of belt material was fastened in place on the adapter by means of a recessed retaining clamp to provide an exposed area of 25 sq. in. Activation of the punch press trigger mechanism forced the belt sample downward onto a tray of bituminous sands directly beneath. By maintaining a consistent depth of sands in the tray, pressure exerted was regulated by the spring tension in the adapter. Preliminary testing yielded optimum reproducibility of results at 8.8 psi with a total of nine impacts. Lateral movement of the tray allowed three repeated stamps over each of three locations on the sands bed.

The tray was filled with homogenized bituminous sands to a depth of 1.5 inches and levelled by guiding a straight edge along its rim. Compressed sand was discarded after each test and replenished with freshly chopped material.

Precoat materials requiring dissolution in an aqueous media were applied in aerosol form until the entire belt surface was wetted.

Tests were conducted at ambient room temperature. Belt samples were weighed before and after impacts. Values for weights of bituminous sand adhering were compared to blank determinations (employing untreated belt samples) and expressed as a release efficiency.

The effect on hot water extraction of release agents which were successful in the release efficiency test was tested in a laboratory-scale batch extraction apparatus. This apparatus had been used for other studies for application at the commercial level. Bituminous sand was extracted without, and in the presence of, the compounds or formulations proposed for use as release agents.

The extraction apparatus comprised a 2 liter capacity stainless steel vessel jacketed in a steel shroud to allow passage of heating water between the vessel and jacket. The vessel was fitted with a driven impellor for stirring the vessel contents. Bituminous sands, belt release agent and sodium hydroxide were introduced together with slurry water into the vessel. This mixture was stirred therein for a period of time; then additional flood water was added and the flotation was carried out. Following are the details of operation:

| Composition of Mixture: | Grams |
|---|---|
| bituminous sands | 500 |
| hot water (at 82° C.) - slurry | 145 |
| - flood | 955 |
| sodium hydroxide | 0.12 |
| belt release agent | ≃0.10 |
| Impellor r.p.m. - 600 | |
| Retention time - 10 min. slurry | |
| - 10 min. primary flotation | |
| Temperature within vessel - 82°C. | |

Froth was recovered by skimming and analyzed for bitumen, water and solids by Soxhlet extraction with toluene.

Following are results obtained during these tests with reference to two water soluble anionic surfactants:

$$\% \text{ Release Efficiency} = 100 - \frac{\text{Tar Sand adhering in presence of release agent} \times 100}{\text{Tar Sand adhering without release agent}}$$

TABLE I

| Composition of Bitumen Emulsion | Belt Release Efficiency | Release Efficiency (%) Medium grade tar sand (11.51% bitumen) | Rich grade tar sand (13.68% bitumen) |
|---|---|---|---|
| 15 g bitumen 3 ml 4% NaOH | to 1l with water | 28.23 | 84.14 |
| 30 g bitumen 6 ml 4% NaOH | to 1l with water | 83.43 | 84.98 |

The embodiments of the invention in which an exclusive property or privilege is claimed are defined as follows:

1. In the process wherein bituminous sands are deposited on and transported by an endless conveyor belt to its end where the sands are unloaded, as the belt rounds the end roller, for use in the hot water extraction process the improvement comprising:

treating the sands-bearing surface of the belt with an emulsion comprising bitumen, derived from bituminous sands by said hot water extraction process, in aqueous sodium hydroxide solution prior to depositing the bituminous sands thereon to provide a release agent which is operative to effect clean separation of the sands from the surface during the unloading operation.

2. The improvement as set forth in claim 1 wherein: said emulsion contains at least 1 wt. % of bitumen.

3. The improvement set forth in claim 1 wherein: said emulsion contains at least 0.1 wt. % of sodium hydroxide.

4. The improvement set forth in claim 1 wherein: the emulsion contains at least 0.1 wt. % of sodium hydroxide; and at least about 0.76 gallons of emulsion is applied per thousand square feet of conveyor belt.

5. The improvement set forth in claim 1 wherein: the bitumen used for said emulsion is in the form of hot water extraction process froth.

6. The improvement set forth in claim 2 wherein: said emulsion contains at least 0.1 wt. % of sodium hydroxide.

7. The improvement set forth in claim 2 wherein: the emulsion contains at least 0.1 wt. % of sodium hydroxide; and at least about 0.76 gallons of emulsion is applied per thousand square feet of conveyor belt.

8. The improvement set forth in claim 2 wherein: the bitumen used for said emulsion is in the form of hot water extraction process froth.

* * * * *